US010273643B1

(12) United States Patent
Parazynski et al.

(10) Patent No.: US 10,273,643 B1
(45) Date of Patent: Apr. 30, 2019

(54) WASTE COLLECTION AND ISOLATING DEVICE AND METHOD OF COLLECTING AND ISOLATING WASTE THEREOF

(71) Applicants: Scott Edward Parazynski, Houston, TX (US); Richard Kyle Dixon, Fulshear, TX (US)

(72) Inventors: Scott Edward Parazynski, Houston, TX (US); Richard Kyle Dixon, Fulshear, TX (US)

( * ) Notice: Subject to any disclaimer, the term of this patent is extended or adjusted under 35 U.S.C. 154(b) by 0 days.

(21) Appl. No.: 16/132,388

(22) Filed: Sep. 15, 2018

(51) Int. Cl.
*E01H 1/12* (2006.01)
*B65F 1/06* (2006.01)

(52) U.S. Cl.
CPC ..... *E01H 1/1206* (2013.01); *B65F 1/062* (2013.01); *B65F 1/068* (2013.01); *E01H 2001/128* (2013.01); *E01H 2001/1226* (2013.01)

(58) Field of Classification Search
CPC ..... E01H 1/1206; E01H 2001/1226; E01H 2001/128; E01H 2001/1266; E01H 2001/1246; B65F 1/062; B65F 1/068; A01K 29/00; B25G 1/00
USPC ..... 294/1.3, 1.4
See application file for complete search history.

(56) References Cited

U.S. PATENT DOCUMENTS 3,823,970 A * 7/1974 Brenner ..... E01H 1/1206 294/1.4
3,984,139 A * 10/1976 Battaglia ..... E01H 1/1206 294/1.4
4,105,241 A * 8/1978 Mee ..... B64G 4/00 294/74
4,225,169 A * 9/1980 DeToma ..... B25J 1/04 294/1.4
4,477,111 A * 10/1984 Crooks ..... E01H 1/1206 294/1.4
4,995,661 A * 2/1991 Aurness ..... E01H 1/1206 294/1.4
5,362,153 A * 11/1994 Lu ..... B60N 3/08 220/495.06
5,562,319 A * 10/1996 Kohler ..... E01H 1/1206 294/1.4

(Continued)

FOREIGN PATENT DOCUMENTS

EP 555932 A2 * 2/1993
EP 3243960 A1 * 4/2017

(Continued)

*Primary Examiner* — Gabriela M Puig
(74) *Attorney, Agent, or Firm* — Steven H Greenfield; Greenfield Invention and Patent Consulting, Inc.

(57) ABSTRACT

A waste collection and isolation device and a method for picking up waste materials without the need for the user to come in contact with the waste are disclosed. The device contains a system for ensnaring solid waste in a bag, a mechanism for activating the system for ensnaring the waste and a system for removing the bag. To use the device, the user installs a bag over a housing containing a plurality of overlapping cords. The user places the opening of the bag over the waste disposed on a surface and then activates the snaring mechanism causing the cords to entangle under the solid waste and to close the bag opening with the waste inside it. The bag comprises a drawstring and a tab in a fixed position. To fully close the bag, the user pulls on the drawstring and pulls the bag onto the tab.

21 Claims, 19 Drawing Sheets

(56) References Cited

U.S. PATENT DOCUMENTS 6,196,601 B1 * 3/2001 Juntunen, Jr. ..... E01H 1/1206 294/1.4
6,305,322 B1 * 10/2001 Patel ..... E01H 1/1206 119/161
6,315,340 B1 * 11/2001 Chen ..... B25B 9/00 294/100
7,080,863 B2 * 7/2006 Cappellano ..... E01H 1/1206 294/1.4
7,287,790 B1 * 10/2007 Kitiashvili ..... E01H 1/1206 294/1.4
7,325,849 B2 * 2/2008 Jones ..... E01H 1/1206 294/1.4
7,625,025 B1 * 12/2009 Zahedi ..... E01H 1/1206 294/1.3
7,841,303 B2 * 11/2010 Perez Tomas ..... A01K 27/004 119/796
7,992,907 B1 * 8/2011 DeJesus ..... E01H 1/1206 294/1.4
9,187,871 B1 * 11/2015 Contreras ..... E01H 1/1206
9,528,233 B2 12/2016 Parazynski et al.
2009/0050065 A1 * 2/2009 Evans ..... E01H 1/1206 119/161
2009/0200812 A1 * 8/2009 Mambru ..... E01H 1/1206 294/1.4
2011/0197825 A1 * 8/2011 Jan ..... E01H 1/1206 119/795
2012/0256430 A1 * 10/2012 Merino-Garcia ..... E01H 1/1206 294/1.3
2014/0152031 A1 * 6/2014 Ballacchino ..... E01H 1/1206 294/1.3

FOREIGN PATENT DOCUMENTS

WO WO-9313268 A1 * 7/1993 ..... E01H 1/1206
WO WO-9320285 A1 * 10/1993 ..... E01H 1/1206
WO WO-2009046229 A2 * 4/2009 ..... E01H 1/1206

* cited by examiner

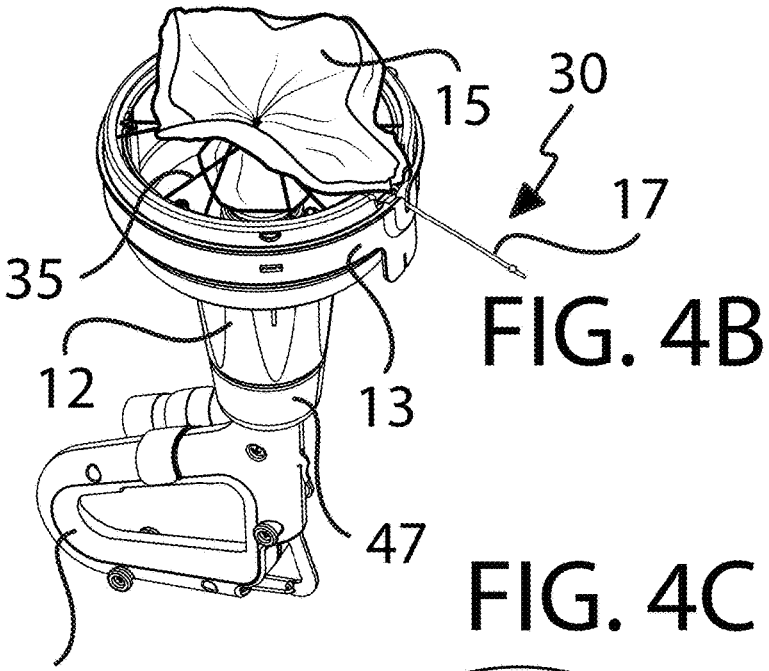
FIG. 4B
FIG. 4C
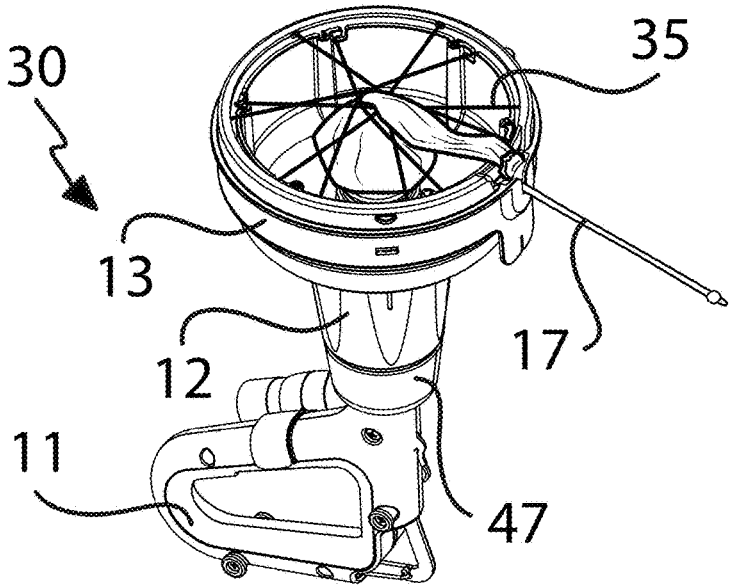

FIG. 13A
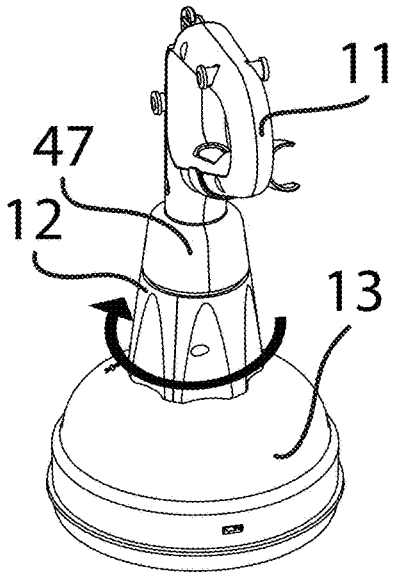
FIG. 13B
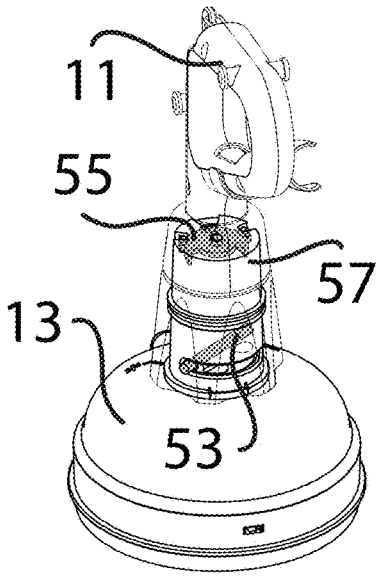
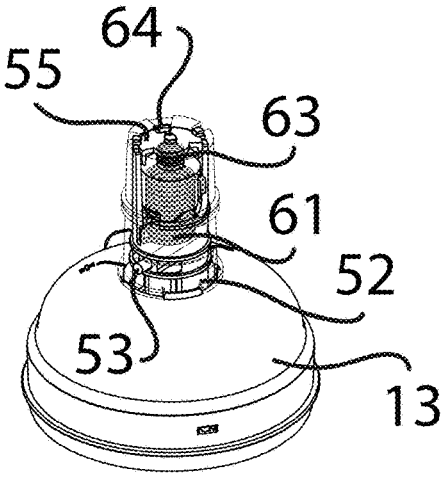
FIG. 13C
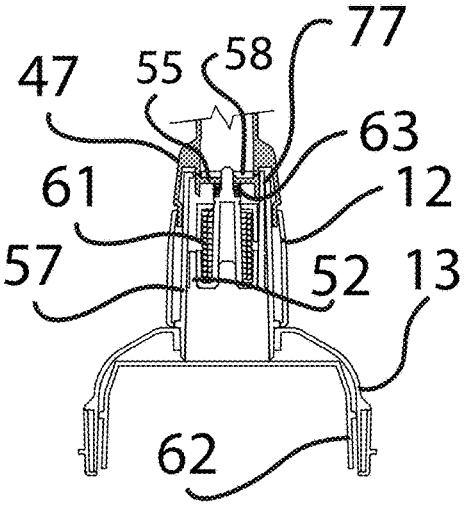
FIG. 13D

WASTE COLLECTION AND ISOLATING DEVICE AND METHOD OF COLLECTING AND ISOLATING WASTE THEREOF

FIELD OF THE INVENTION

The present invention relates to a waste collection and isolation device and a method for picking up solid waste materials remotely off a surface without the need for the user to come in contact with the waste. More specifically the present invention relates to a device for picking up solid waste materials disposed on surfaces having various contours, rigidity and shapes such as asphalt, concrete, grass, foliage or snow as well as indoor surfaces like floors and carpeting.

The waste collection and isolation device is particularly suited for removing undesirable objects such as: dead mice, poison mushrooms and feces of dogs as well as other domesticated and farm animals such as cats, rabbits, cows or horses. The waste collection and isolation device may similarly be used for picking up and removing other hazardous waste materials such as nuclear, chemical, biological and medical products as well as picking fruit off trees. The device is configured to minimize the risk of contamination of the device and the user.

BACKGROUND OF THE INVENTION

U.S. Pat. No. 9,528,233 B2 teaches a device that places an open flexible bag over pet droppings on a surface and a mechanism for ensnaring the droppings while remotely closing the opening of the bag containing the droppings for disposal. The present invention offers several upgrades and improvements to the device described in U.S. Pat. No. 9,528,233 B2. The upgrades relate to activation of the snaring mechanism and the removal of the bag in such a manner that the user avoids contact with the bag in the course of its removal and disposal.

SUMMARY OF THE PRESENT INVENTION

In one aspect of the present invention, a device for collecting and isolating waste materials comprises: a system for ensnaring solid waste in a bag; a system for removing the solid waste remotely; and a mechanism for activating the system for ensnaring the solid waste in the bag.

In another aspect of the present invention, a method for picking up and isolating waste comprises: providing a waste collection and isolating device, the waste collection and isolating device containing: a system for ensnaring solid waste in a bag; a system for removing the solid waste; and a mechanism for activating the system for ensnaring the solid waste in the bag; rotating a turning collar of the waste collection and isolating device to a second position from a first position, the first position corresponding to a state of minimum open space between cords attached to a bottom of a waste collection housing, the second position corresponding to a state of maximum open space between the cords attached to a bottom of a waste collection housing; installing a containment system into the waste collection housing such that a containment system bag is stretched over the bottom of the waste collection housing to form an opening to an inside of the bag; placing the opening of the bag over a solid waste disposed on a surface and pressing onto a handle, wherein pressing down on the handle triggers the mechanism for activating the system for picking up the solid waste in the bag, the picking up being accomplished by entangling the cords around the bag opening and under the solid waste, causing the solid waste to be ensnared inside the bag and causing the turning collar to return to the first position; isolating the solid waste by closing the opening of the bag, the closing the opening of the bag being accomplished by pulling on a drawstring, the pulling on the drawstring causing a drawing-in of the bag opening; and disposing of the bag with the ensnared solid waste.

These and other features, aspects and advantages of the present invention will become better understood with reference to the following drawings, description and claims.

BRIEF DESCRIPTION OF THE DRAWINGS

FIGS. 4B and 4C portray steps of closing the collection bag opening;

FIGS. 13A-13D portray the configuration of the device in the second step in the process of collecting solid waste using the waste collection and isolation device;

DETAILED DESCRIPTION OF THE INVENTION

Figure 1:
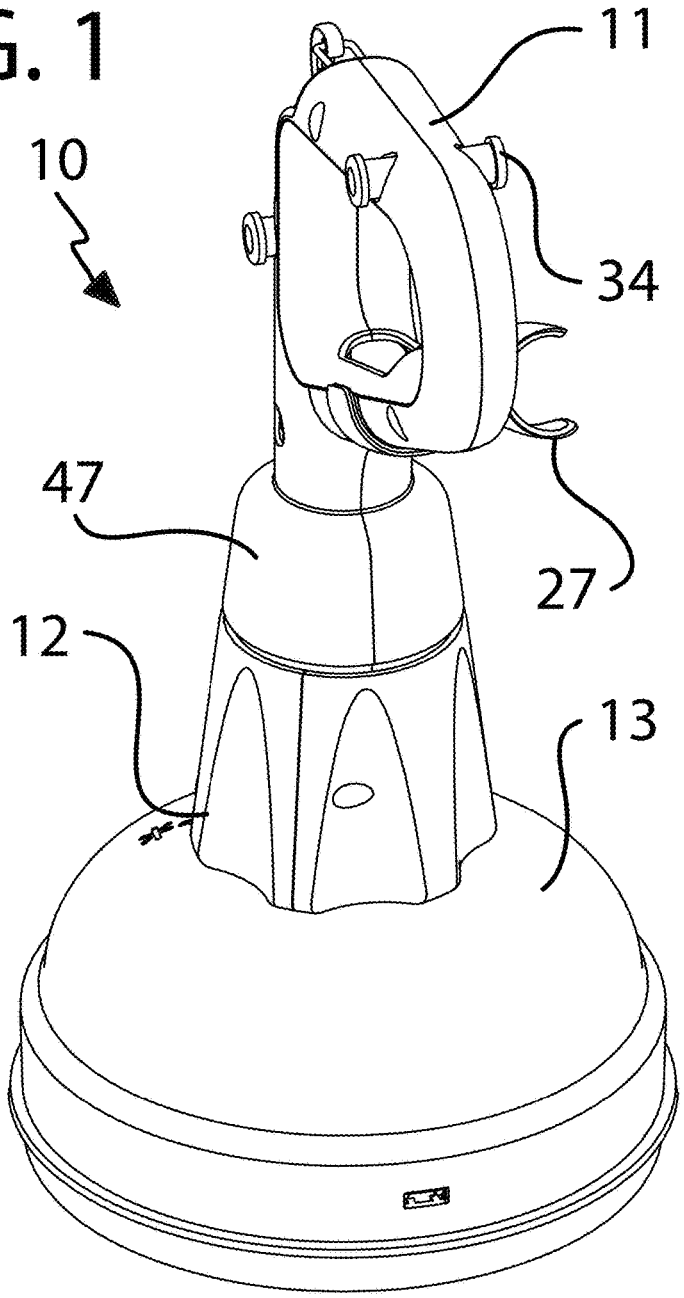
FIG. 1 is a side perspective view of the waste collection and isolation device.
Figure 2:
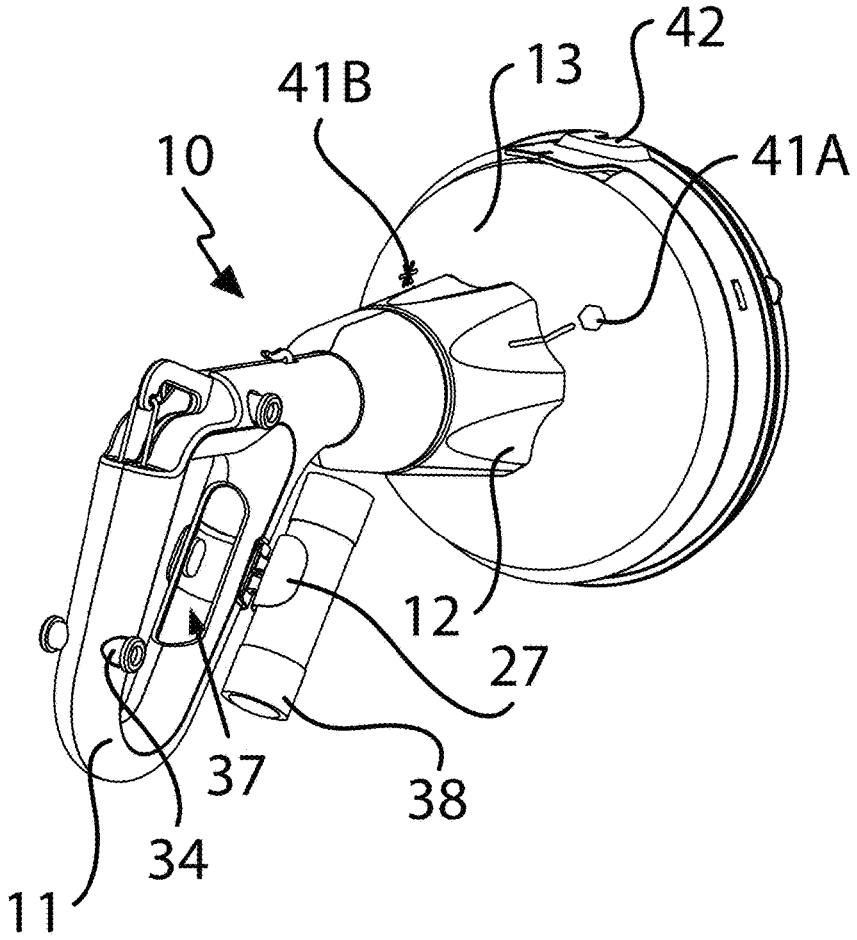
FIG. 2 is a top perspective view of the waste collection and isolation device.

The following detailed description is of the best currently contemplated modes of carrying out exemplary embodiments of the invention. The description is not to be taken in a limiting sense, but is made merely for the purpose of illustrating the general principles of the invention.

The present device for collecting and isolating waste 10 comprises three systems that work in tandem: 1) a system for ensnaring solid waste into a bag off a surface, 2) a system for closing the bag remotely, and 3) a mechanism for actuating the system for ensnaring the solid waste in the bag.

The device for collecting and isolating waste 10 and the method of using the device for picking up waste are illustrated in FIGS. 1-20. The device for collecting and isolating waste 10 is equipped with a handle 11 for holding and carrying the device. The handle 11 contains a compartment 37 for storing waste containment bags and a clip 27 for attaching a flashlight 38 to illuminate in the dark. The handle 11 may also contain a belt clip attachment 34 for belt clip 44 and optionally other accessories such as pepper spray, hand sanitizing liquid and utility pouch.

The handle may also contain a carabiner clip to hold a leash.

The handle 11 is incased by actuating system housing support cover 47 while turning collar 12 situated below actuating system housing support cover 47 is used to activate one of the waste collection steps. Signs 41A and 41B are position identifiers used for marking the position of the turning collar 12. The system for picking up the solid waste in bag 15 is contained inside waste collection housing 13.

Figure 16:
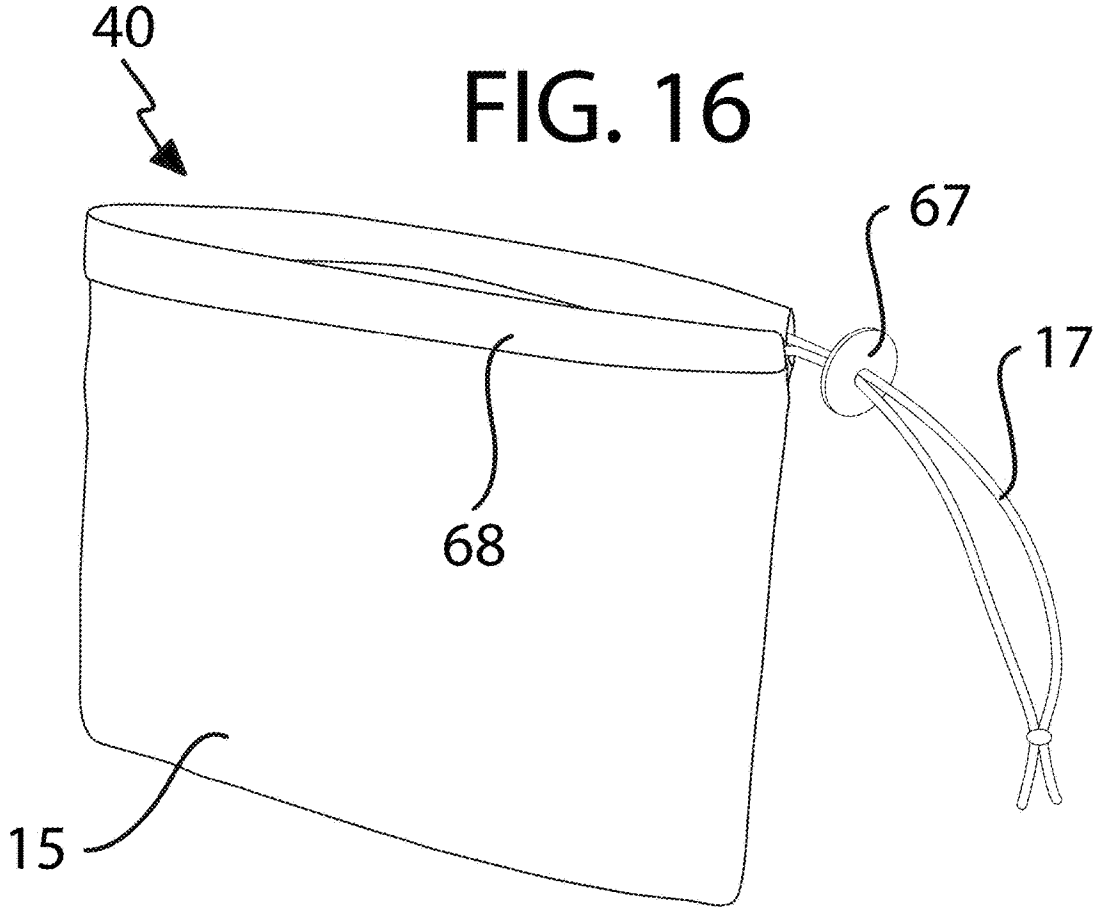
FIG. 16 depicts the waste containment device that may be used with the waste collection and isolation device for collecting, storing and isolating waste materials.
Figure 17B:
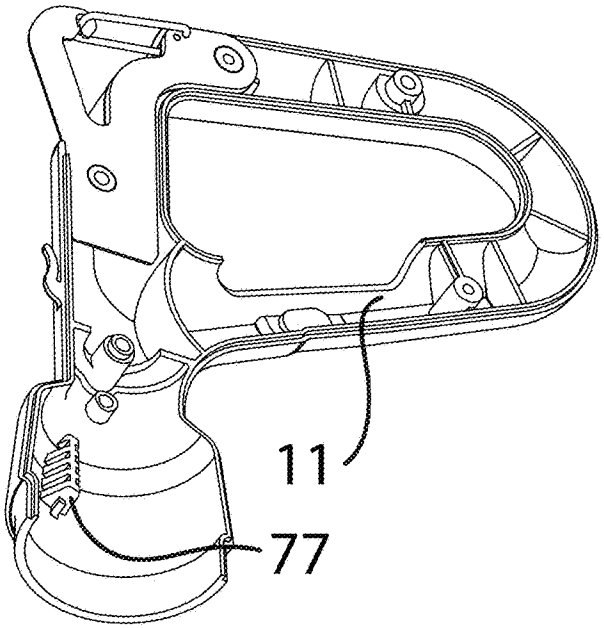
FIGS. 17A and 17B present a first embodiment of a component of the waste containment device in a side perspective view and in a cross sectional side perspective view.
Figure 17A:
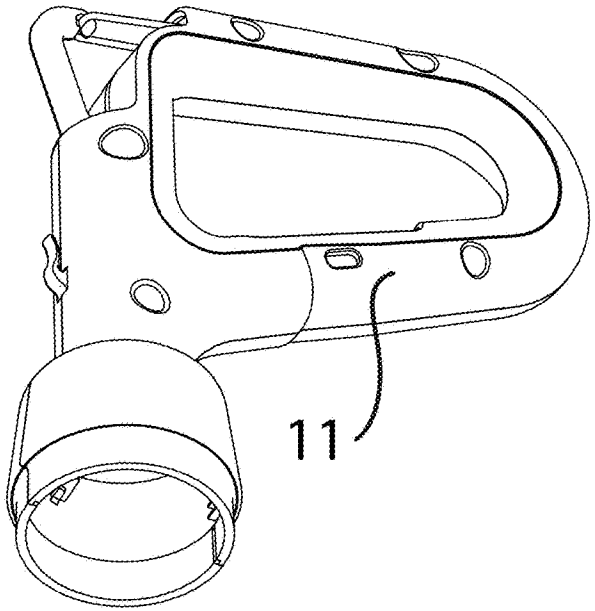

Containment system 40 is used for collecting and isolating the waste remotely and in a way that the user does not come in contact with the waste. The containment system 40 comprises of flexible bag 15 having a drawstring 17 threaded through a channel 68 around the opening of the bag 15. The two ends of the drawstring 17 are threaded through the center of tab 67 and are attached to one another behind the tab 67 as shown in FIG. 16.

Figure 3:
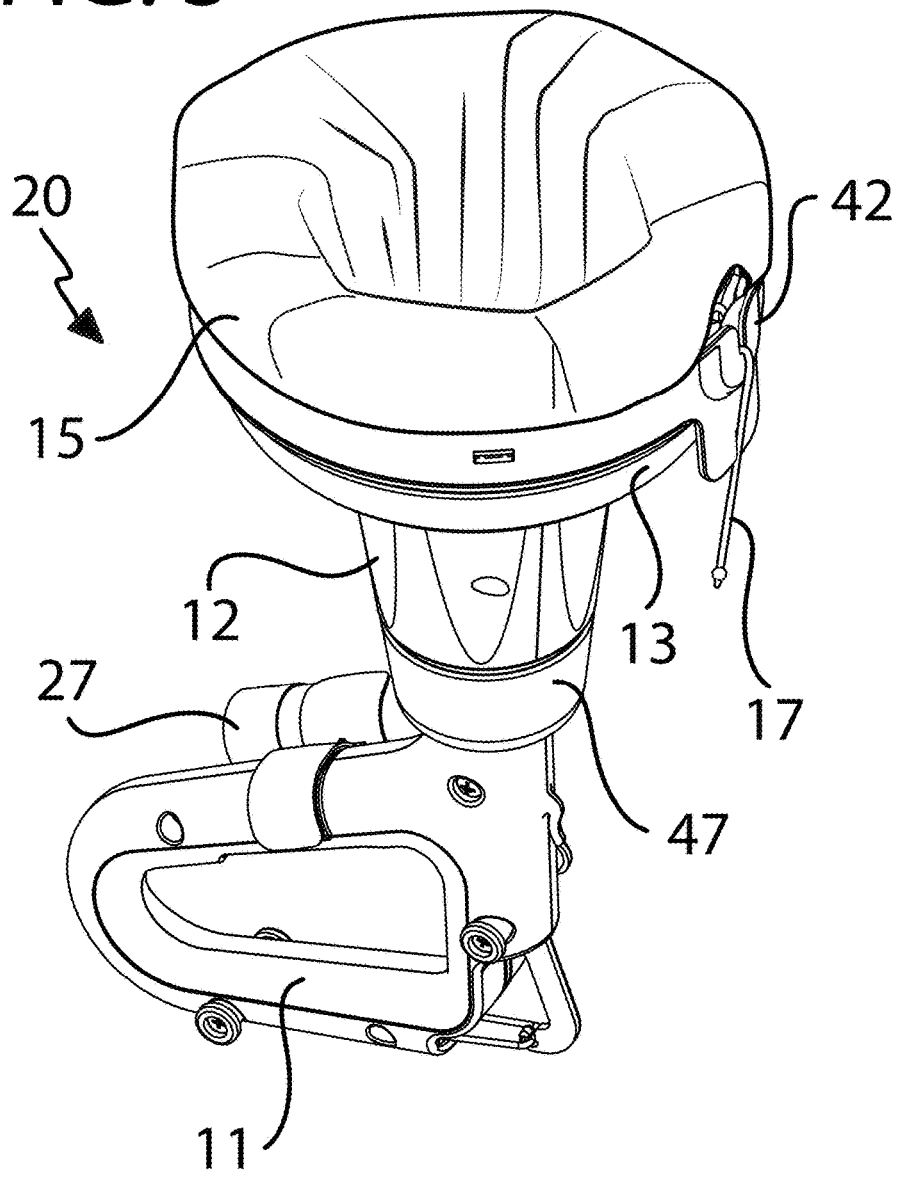
FIG. 3 is a bottom perspective view of the waste collection and isolation device showing the installed collection bag and the device in a ready to use mode.

The bag 15 is stretched over the bottom opening of waste collection housing 13 and the tab 67 is seated inside tab holding slot 42 attached to waste collection housing 13 and held in a fixed position. The two ends of drawstring 17 threaded through tab 67 protrude out of the tab 67 and holding slot 42 as shown in FIG. 3. The drawstring 17 is made of elastic yet strong material. The section of the drawstring 17 that protrudes out of the tab 67 and holding slot 42 may be pulled out to tighten the elastic drawstring 17 around the bottom opening of the waste collection housing 13 to keep it securely in place.

Figure 6A:
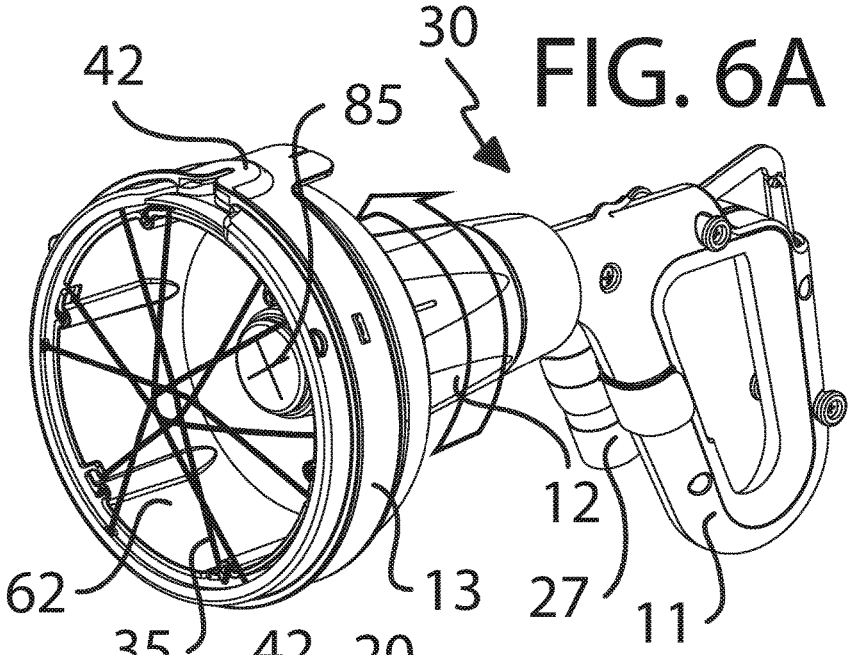
FIG. 6A is a bottom and side perspective view of the waste collection and isolation device in post waste collection position.
Figure 6B:
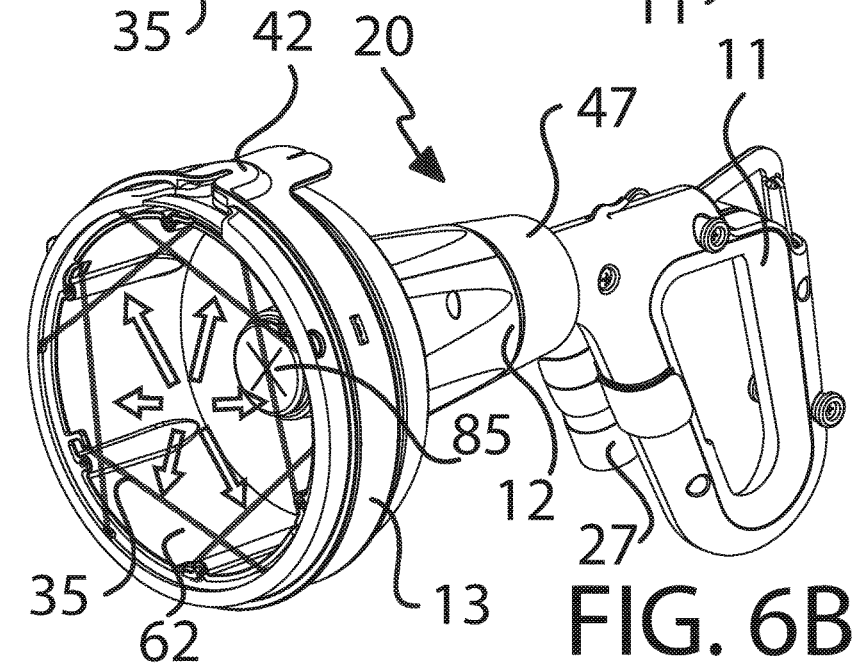
FIG. 6B is a bottom and side perspective view of the waste collection and isolation device in a position for installing a bag in a pre-waste collection position.

The waste collection housing 13 comprises an inner ring 62 situated around the inner walls of the waste collection housing 13 and adapted for rotation inside waste collection housing 13. The inner bottom of waste collection housing 13 and the inner ring 62 comprise of a plurality of attachment points for attaching elastic cords 35. Each elastic cord 35 is attached at one end to an attachment point on the inner bottom of waste collection housing 13 and an attachment point on the inner ring 62 as shown in FIG. 6B. In the embodiment of FIG. 6B, six individual cords are each attached to an attachment point on waste collection housing 13 at one end and to an attachment point on the inner ring 62 at the other end. However, additional attachment points and cords also fall within the scope of this embodiment. The cord attachments shown in FIG. 6B represent a pre-use configuration 20 in which the cords are arranged in such a manner that they provide the widest open area in the center for inserting and positioning bag 15 as shown in FIG. 3.

Figure 4A:
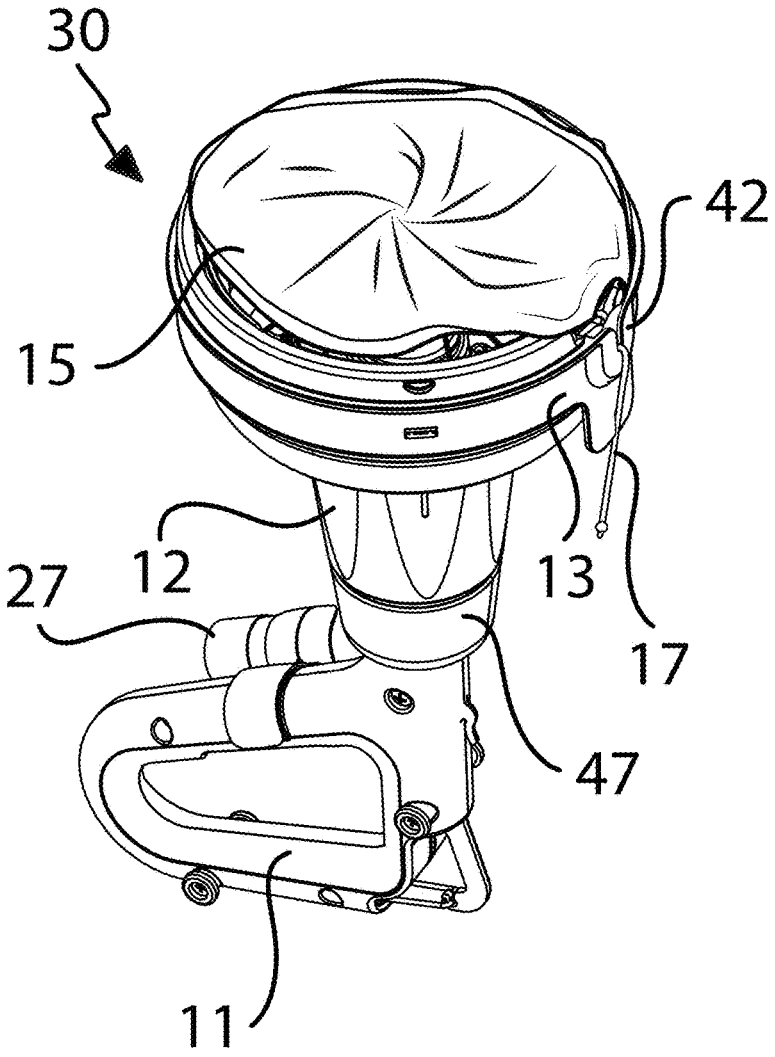
FIG. 4A illustrates a bottom view of the waste collection and isolation device showing the collection bag after the waste was ensnared in the bag.
Figure 5:
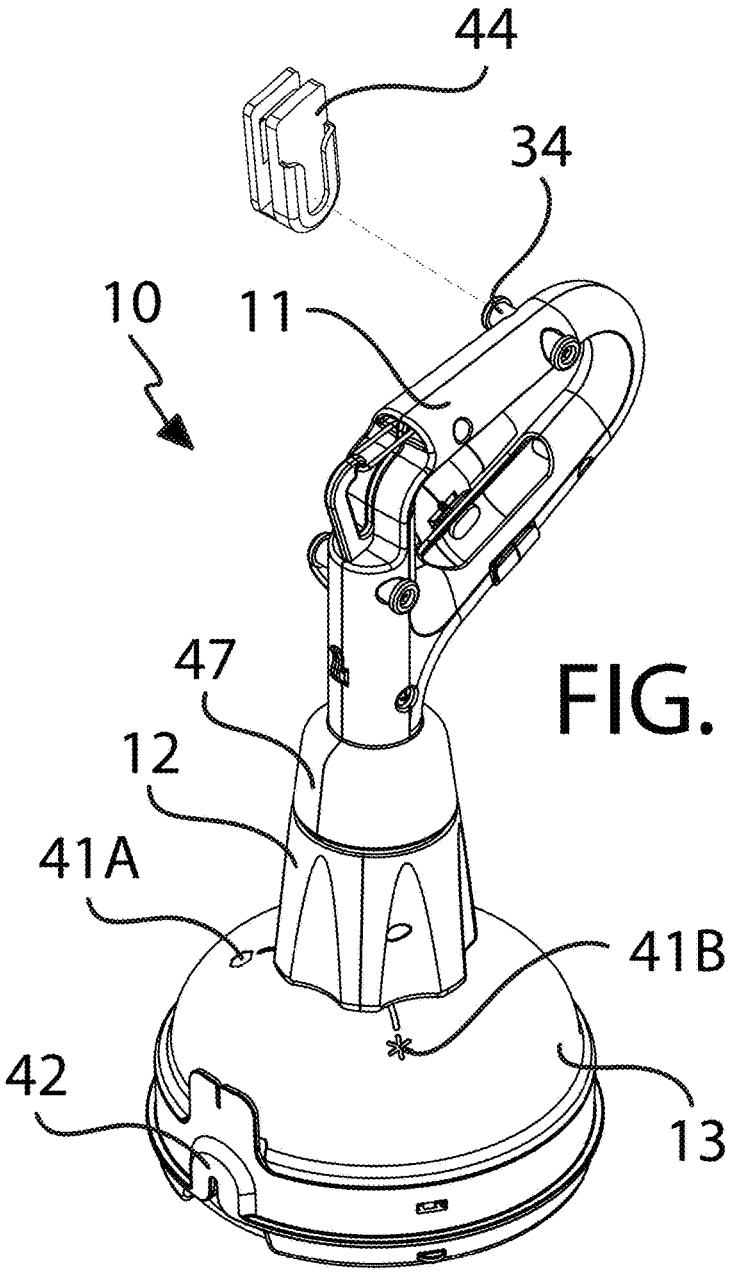
FIG. 5 is a second side perspective view of the waste collection and isolation device.

Rotating the inner ring 62 clockwise causes the cords 35 to intertwine and reduce the center opening. The twisting of the cords 35 also creates a downward thrust on the cords 35 such that the center opening is formed at the level of the bottom housing lip before bouncing upwards due to cord flexing. This is illustrated in FIG. 6A which represents a post use configuration 30 in which the open area in the center between the elastic cords 35 is at its narrowest. With the bag 15 installed, turning the inner ring 62 clockwise results in pinching the bag at the center as illustrated in FIG. 4A. The combination of the scooping motion and center opening reduction created by the twisting of the cords 35 causes the ends of the bag 15 to be pulled off the outer side of the waste collection housing 13 on which it is stretched in the pre-use configuration as presented in FIG. 4A.

Figure 7:
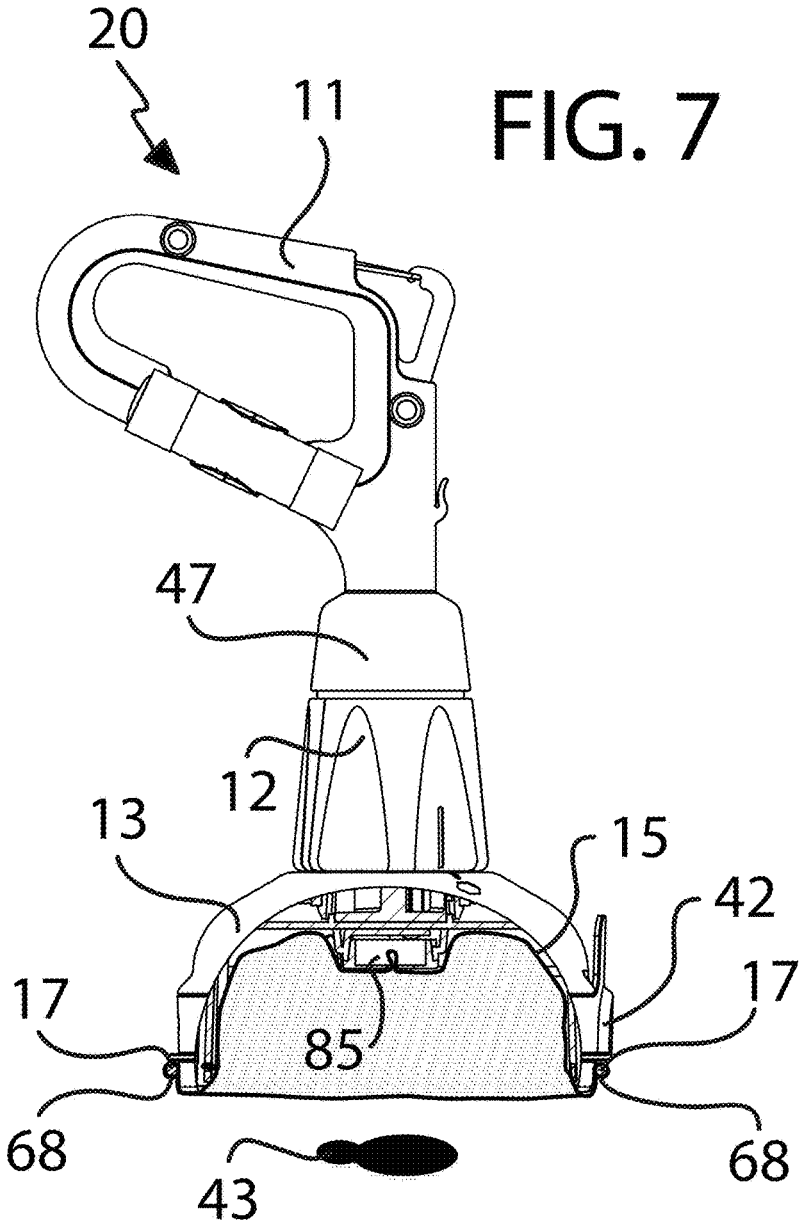
FIG. 7 is a side sectional view of the waste collection and isolation device positioned over solid waste and in a ready for pick up mode.
Figure 8:
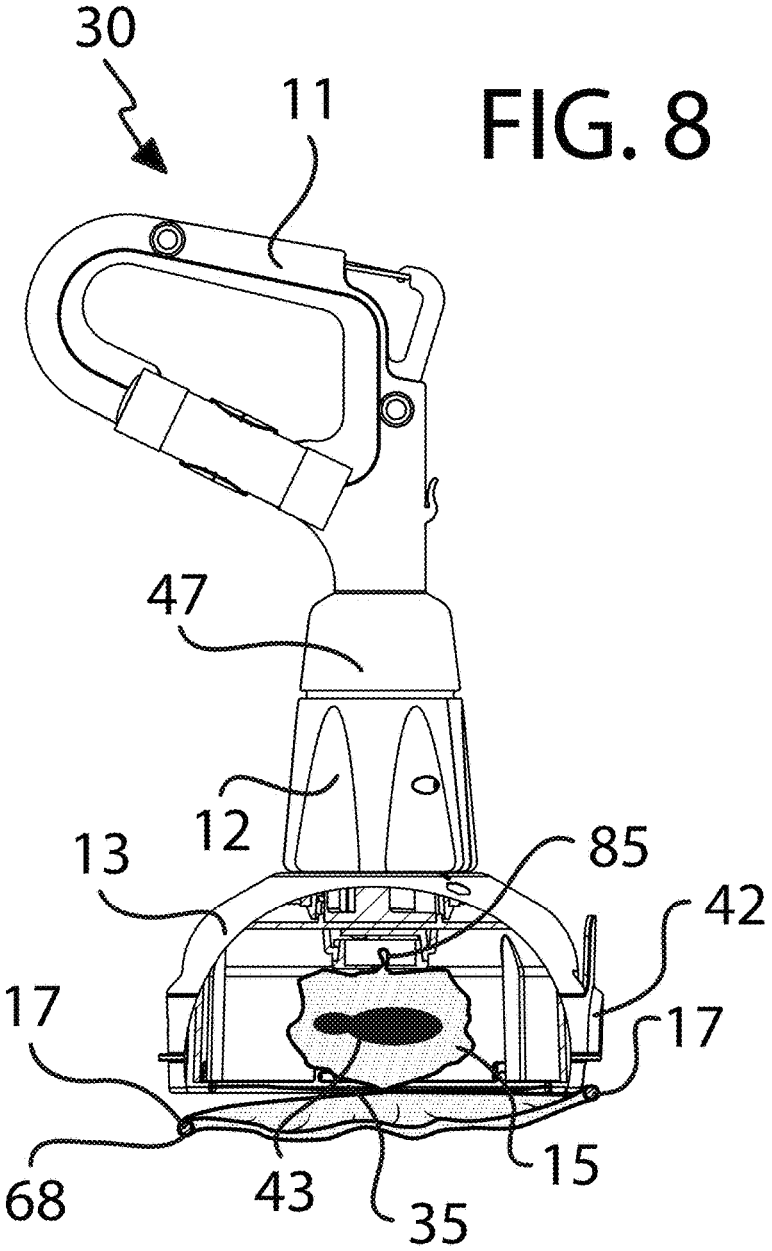
FIG. 8 is a side sectional view of the waste collection and isolation device positioned after the solid waste was collected in the bag.
Figure 9:
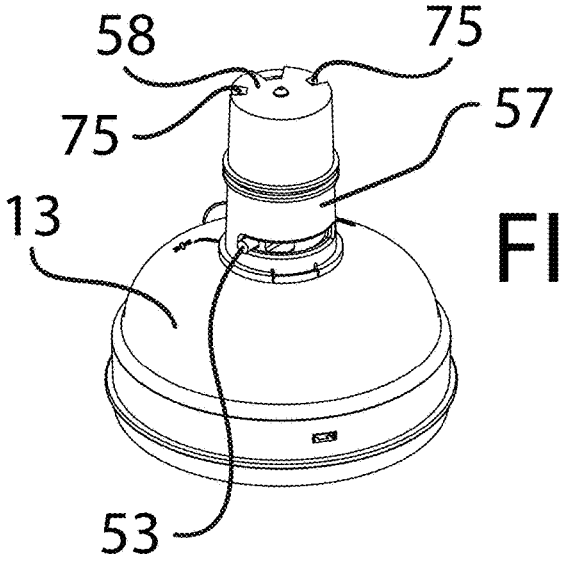
FIGS. 9-11 show details of various components and inner parts of the waste collection and isolation device.
Figure 10:
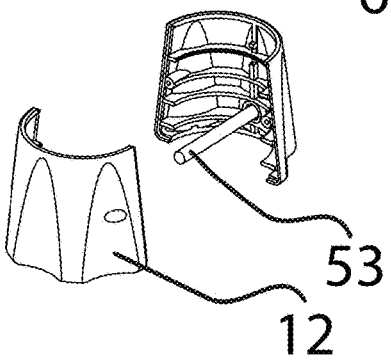
Figure 11:
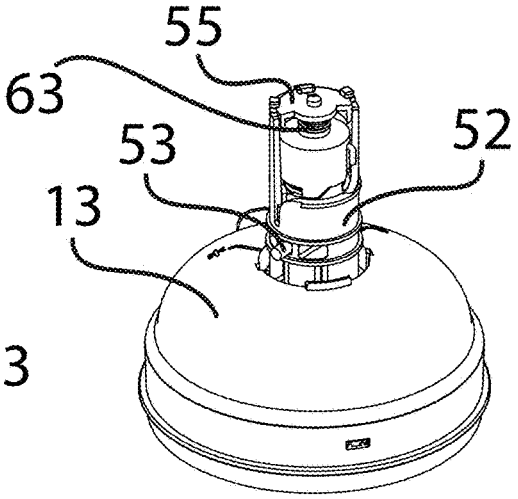
Figure 12A:
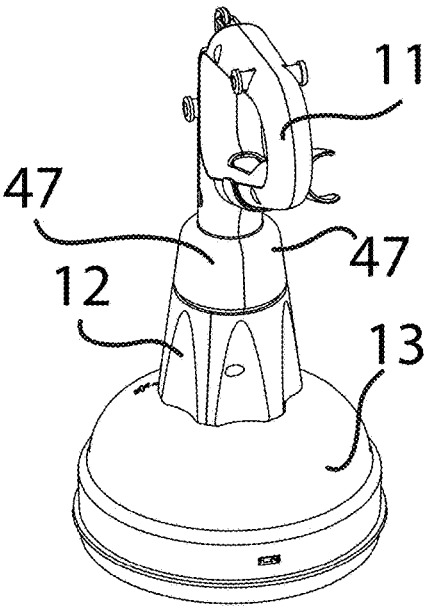
FIGS. 12A-12D portray the configuration of the device in the first step in the process of collecting solid waste using the waste collection and isolation device.
Figure 12B:
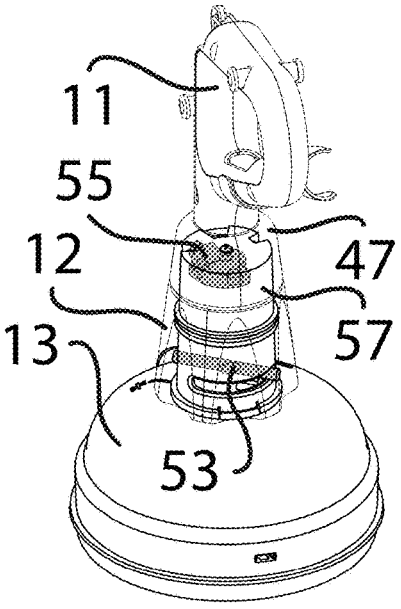
Figure 12C:
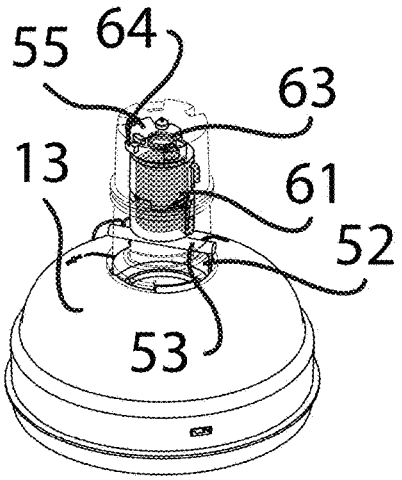
Figure 12D:
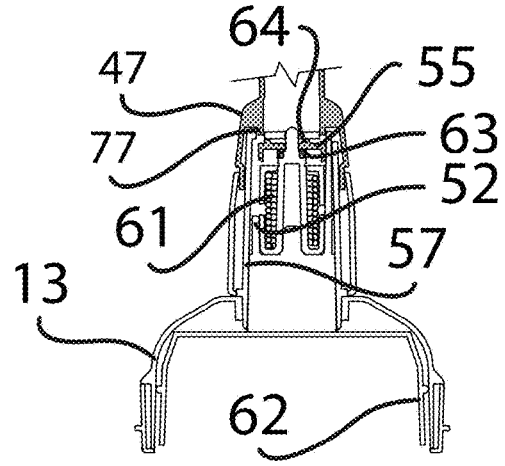

FIGS. 7 and 8 illustrate respectively pre-utilization 20 and post-utilization 30 embodiments of the waste collection and isolating device 10 for picking up solid waste 43 off a surface and isolating it in a bag 15. The device is positioned such that installed open bag 15 is centered over solid waste 43. Turning inner ring 62 clockwise causes the bag 15 to be pinched at about surface or ground level. This results in the waste 43 being snared inside the bag 15.

The system and the stepwise process for turning the inner ring 62 clockwise and actuating the system for cinching the bag 15 are depicted by FIGS. 9-14.

A cross pin 53 is wedged at each end in opposing grooves inside the turning collar 12. In a pre-use configuration 20, the turning collar 12 is adapted for movement clockwise which results in turning the cross pin 53. The cross pin 53 is engaged with a torsion spring 61 disposed over the cross pin 53 in a manner that turning the cross pin 53 clockwise applies a compression force onto the torsion spring 61 and renders it under tension. The torsion spring 61 is engaged with a clutch disk 55 disposed on a support spring 63 that applies upward pressure onto the clutch disk 55 to prevent inadvertent movement of the clutch disk 55. The support spring 63 is disposed over the torsion spring 61. The clutch disk 55 is configured for turning sideways and for upward and downward movements. The compression of the torsion spring 61 actuated by turning the cross pin causes the clutch disk 55 to turn clockwise.

The torsion spring 63 is also engaged with actuating system inner housing 52 which, in turn, is engaged with inner ring 62 in a manner that a clockwise turn of the cross pin 53 and torsion spring 61 causes an equivalent clockwise turn of actuating system inner housing 52 and inner ring 62. Conversely, a counterclockwise turn of the cross pin 53 and torsion spring 63 causes an equivalent counterclockwise turn of actuating system inner housing 52 and inner ring 62. The cross pin 53, the torsion spring 61, the clutch disk 55 and the support spring 63 for the clutch disk 55 are all supported by the actuating system inner housing 52 and are encased by the actuating system outer housing 57. The clutch disk 55 is pressed against the upper wall 58 of the stationary outer housing 57 by clutch disk support spring 63. The clutch disk 55 contains three tabs 64 that are disposed on the top surface of the clutch disk 55. It is noted that more or fewer than three tabs may be used. The upper wall 58 of the outer housing 57 contains three indentations 75 configured to house the three tabs 64 that are disposed on the top surface of the clutch disk 55 when the clutch disk 55 is turned by the cross pin 53 to compress the torsion spring 61.

Figure 18B:
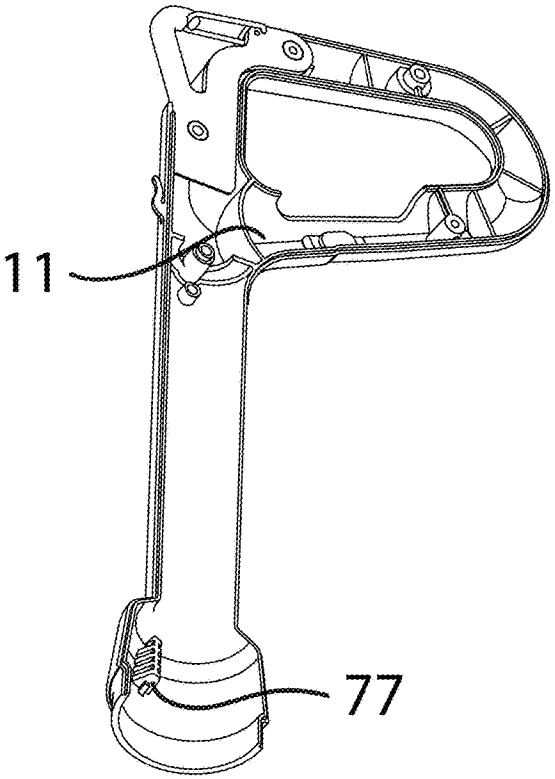
FIGS. 18A and 18B are drawings of a second embodiment of the component of the waste containment device presented in FIGS. 17A and 17B, FIGS. 19A and 19B provide a first alternate configuration of the mechanism for actuating the system for ensnaring the solid waste shown in a cross sectional side perspective view.
Figure 18A:
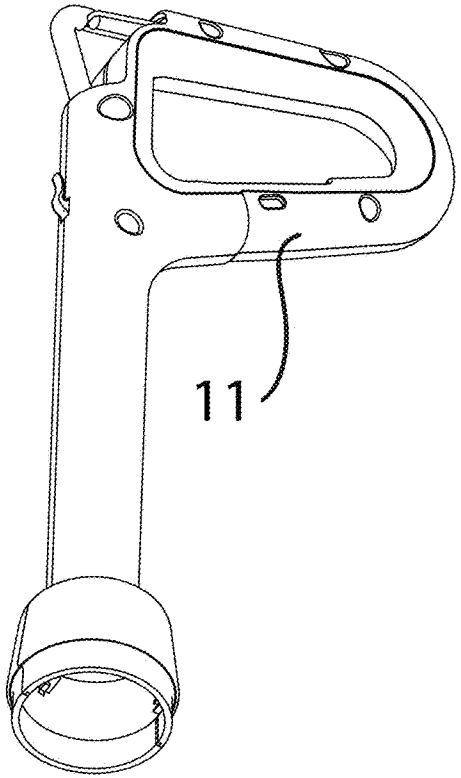

The bottom part of handle 11 contains prongs 77 that are affixed to the handle 11 and whose position is over and directly opposing indentations 75 on the outer housing 57. The handle 11 is configured for downward movement which would result in insertion of the prongs 77 into the indentations 75. It is noted that the handle 11 comprising an elongated middle section is also within the scope of the current waste collection and isolation device 10 as shown in FIGS. 18A and 18B. An elongated handle middle section enables the user to avoid having to bend down in order to reach the waste.

The cross pin 53, the torsion spring 61, the clutch disk 55 and the prongs 77 on the handle 11 represent the actuation system for picking up the waste 43 and collecting it in a bag 15. As such, the clockwise rotation of the cross pin 53 compresses torsion spring 61 and rotates clutch disk 55. Pressing handle 11 causes the prongs 77 to push tabs 64 out of indentations 75 which releases the tension on the torsion spring 61 and causes the actuation system to reset to its pre-use configuration. The actuation system is engaged with bag cinching ring 62 through actuating system inner housing 52 such that turning the cross pin 53 clockwise also turns the cinching inner ring 62 clockwise.

In the inactive configuration of the waste collection and isolation device 10, torsion spring 61 is in a relaxed state and the clutch disk support ring 63 applies pressure on the clutch disk 55 to keep it pressed against the upper wall 58 of the outer housing 57. In this position, tabs 64 on the clutch disk 55 do not line up with their corresponding indentations 75 on the outer housing 57. This configuration of the mechanism for actuating the system for ensnaring the solid waste is depicted in FIGS. 12A-14D and, in the inactive position, snaring cords 35 are intertwined as shown in FIG. 6A.

To transform the waste collection and isolation device 10 to a ready to use configuration, the user would turn the collar 12 clockwise as shown in FIG. 13A. An approximate turning angle is 110 degrees; however the turning angle may be more or less than 110 degrees. Turning the collar 12 clockwise forces the cross pin 53 and the clutch disk 55 to turn clockwise an equivalent degree turn against the upward pressure exerted by the support spring 63 on the clutch disk 55. The tabs 64 on the clutch disk 55 slip into and become wedged in indentations 75 on the outer housing 57 which affixes the position of the clutch disk 55, maintains tension on the torsion spring 61 and prevents it from springing back into its relaxed configuration. Turning the collar also unwinds the snaring cords 35 into a configuration shown in FIG. 6B. The user would then install waste containment system 40 into housing 13 by first inserting tab 67 and drawstring 17 in tab holding slot 42, then spreading open the bag 15, stretching the open mouth of the bag 15 over the outer rim of the housing 13 and inserting a portion of the bag 15 wall into gripping member 85 situated at the top of external housing 13. The gripping member 85 helps maintain the containment system 40 in place. In the next step, the user places the device 10 with the open bag 15 over the solid waste 43 as shown in FIG. 7. In the inactive position, the cords 35 are twisted in such a way that the space in the center between the cords 35 is configured to be at a minimum level such that the cords 35 pinch the bag 15. In the ready to use configuration, the space between the cords 35 is configured to be at a maximum to facilitate the installation of the bag 15.

Figure 14A:
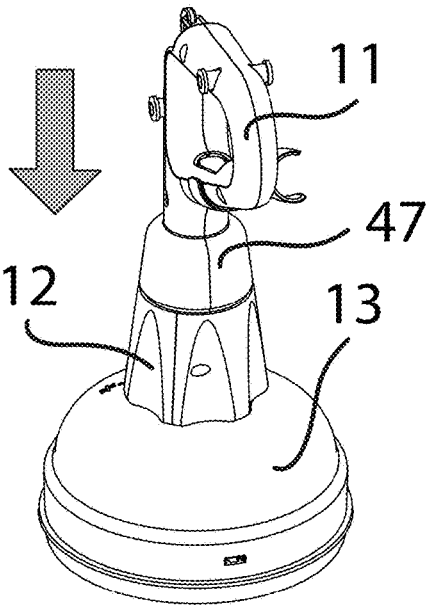
FIGS. 14A-14D portray the configuration of the device in the third step in the process of collecting solid waste using the waste collection and isolation device.
Figure 14B:
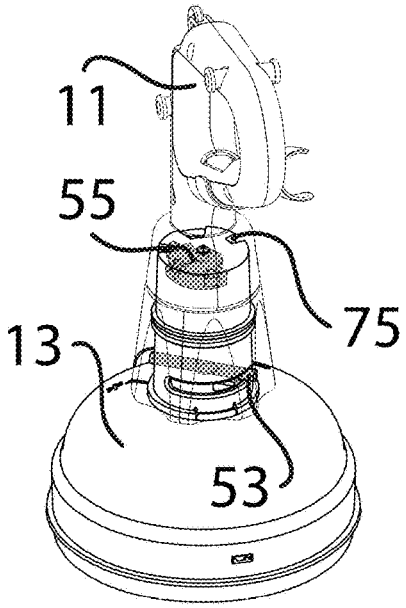
Figure 14C:
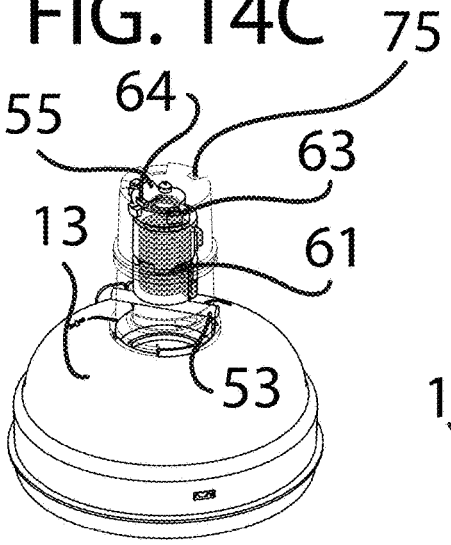
Figure 14D:
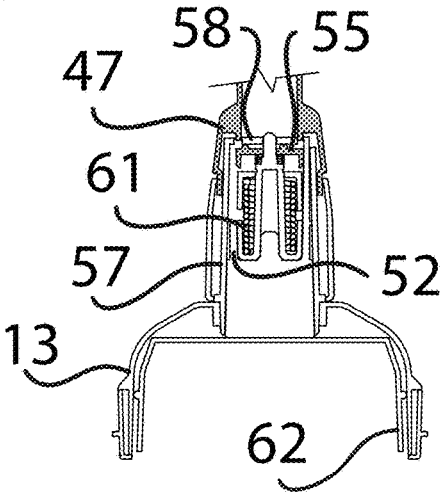
Figure 15:
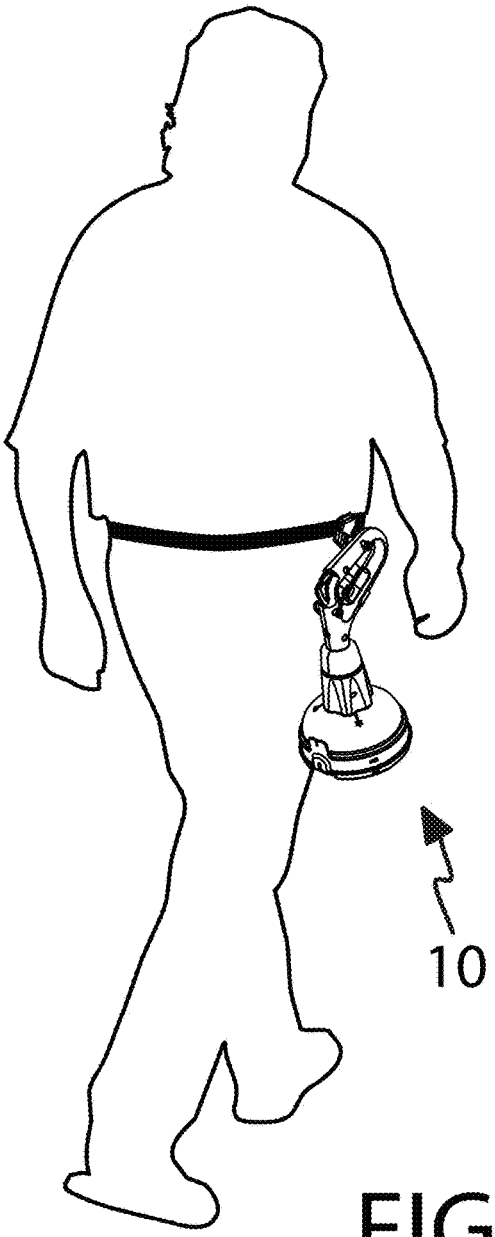
FIG. 15 shows a person carrying the waste collection and isolation device.

Next, the user presses onto handle 11 downward as portrayed in FIG. 14A. This causes the prongs 77 on the bottom of the handle 11 to push down on tabs 64 disposed on the clutch disk 55 causing them to dislodge from the indentations 75 in outer housing 57. This, in turn, releases the tension on torsion spring 61 causing torsion spring 61 to spring back to its relaxed position and shift the cross pin 53 back to its original first position. Likewise, the bag cinching ring 62 is rotated to twist cords 35 causing the open mouth of bag 15 to close under the solid waste 43 which is picked up and captured inside bag 15 as shown in FIG. 8. The springing back of the torsion spring takes place in a very short time which helps generate the downward thrust on the cords causing them to flex downward and twist around the bag opening at the surface or ground level and to get underneath the waste and lift it into the bag before the opening closes.

Next the user pulls on drawstring 17 which pulls the bag out of the twisted cords 35 through the narrow opening in the cords 35 toward tab 67 held in a fixed position in pocket 42 until the drawn-in opening of the bag 15 is covered with the tab 67.

The tab 67 is preferably made of a strong yet flexible and bendable plastic and as the drawn-in opening of the bag 15 is pulled onto the tab 67, the tab 67 forms a dome over the drawn-in opening of the bag 15 that prevents any unpleasant odors, germs or other hazardous gases from escaping out of the bag 15 as shown in FIG. 4C. Thus, while twisting the cords 35 around the bag opening and drawing in the bag opening with the drawstring 17 substantially closes the bag 15, the tab 67 forms an additional barrier over the mouth of the bag 15 and secures any bio-hazardous contamination that may have deposited on the inner surface of the bag 15 to be contained inside the bag 15. The preferred shape of the tab 67 is circular, however, other shapes including but not limited to square, rectangular, and multi-sided also fall within the scope of the present invention.

At this stage, the user may dispose of the containment system 40 including the bag 15, tab 67 and drawstring 17. It is noted that the user does not come in contact with the waste 43 or the bag 15; only with the drawstring from a distance removed from the bag. This setup minimizes the probability of contaminating the user or the device. The steps for closing the bag 15 and covering its drawn in opening with the tab 67 is illustrated in FIGS. 4B and 4C.

Figure 19B:
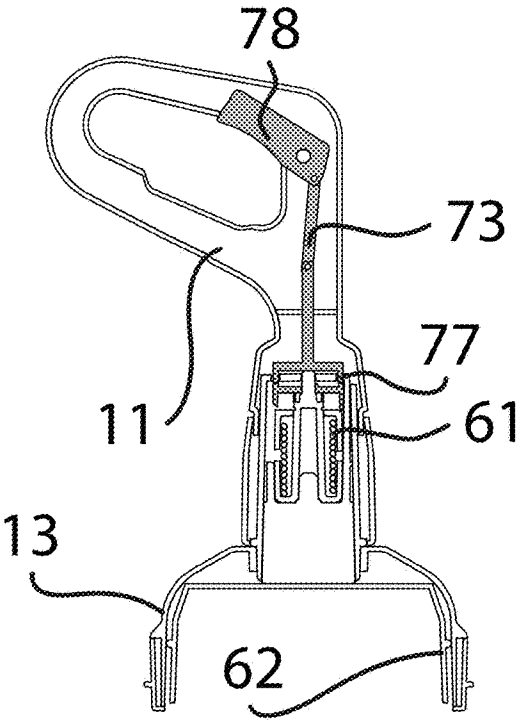
Figure 19A:
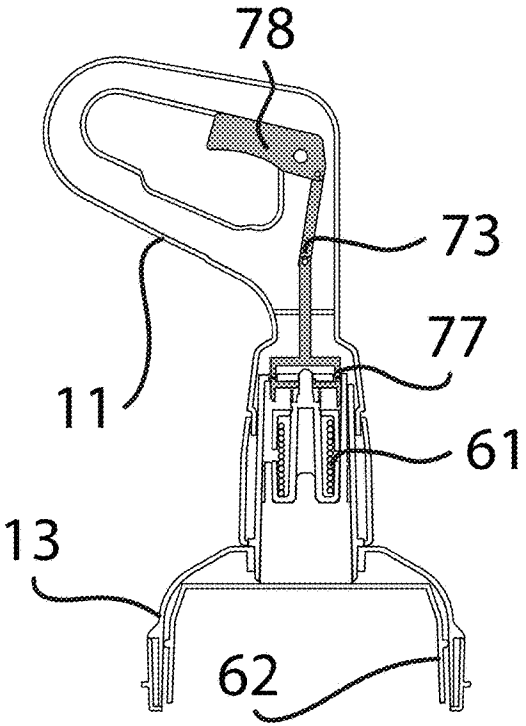
Figure 20B:
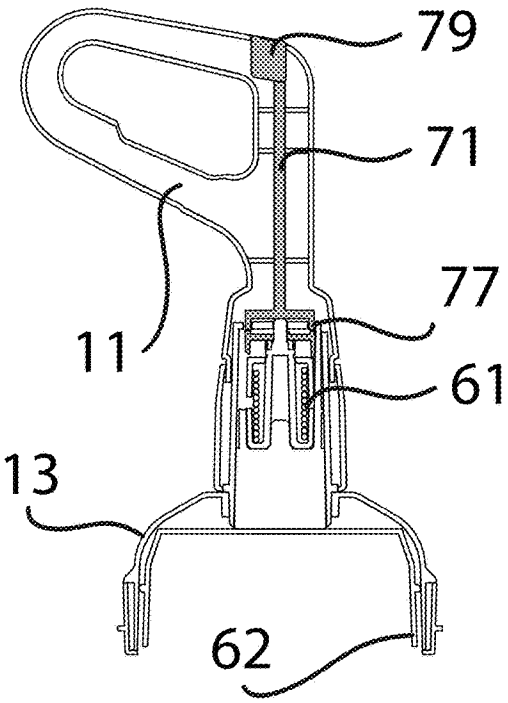
FIGS. 20A and 20B show a second alternate configuration of the mechanism for actuating the system for ensnaring the solid waste shown in a cross sectional side perspective view.
Figure 20A:
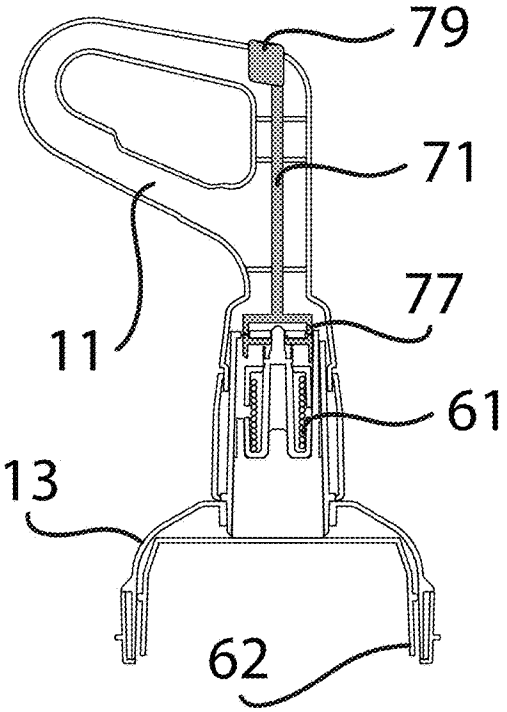

An alternate embodiment for actuating the system for ensnaring the solid waste is depicted in FIGS. 19A and 19B. Pressing trigger 78 upward causes lever arm 73 to press down onto the prongs 77 and to push tabs 64 out of indentations 75 which releases the tension on the torsion spring 61 and causes the actuation system to reset to its pre-use configuration. Another alternate embodiment for actuating the system for ensnaring the solid waste is shown depicted in FIGS. 20A and 20B. Pressing button 79 downward causes arm 71 to press down onto the prongs 77 and to push tabs 64 out of indentations 75. This releases the tension on the torsion spring 61 and causes the actuation system to reset to its pre-use configuration.

It should be understood, of course, that the foregoing relates to exemplary embodiments of the invention and that modifications may be made without departing from the spirit and scope of the invention.

We claim:

1. A waste collection and isolating device comprising:
a system for ensnaring solid waste in a bag;
a system for removing the solid waste; and
a mechanism for activating the system for ensnaring the solid waste in the bag; wherein the system for ensnaring solid waste in a bag comprises: an external housing having an open bottom, an outer surface and an inner surface; an inner ring disposed inside of and against the inner surface of the external housing, said inner ring being configured for rotation inside the external housing, the rotation being actuated by the mechanism for activating the system for ensnaring the solid waste in the bag, said inner ring having an open bottom; and a plurality of cords having a first end and a second end, wherein each cord of the plurality of cords is attached to a connecting point on the inner surface of the external housing open bottom at the first end, and attached to a connecting point on an inner surface of the open bottom of the inner ring at the second end in such a manner that the plurality of cords forms an intertwining network having an open space in a center of the network, wherein turning the inner ring clockwise from a first position to a second position causes a center open space between the cords to increase from a minimum level to a maximum level and turning the inner ring counterclockwise from the second position to the first position causes the cords to twist around one another and to decrease the center open space between the cords from a maximum level to a minimum level; wherein the mechanism for activating the system for ensnaring the solid waste in the bag comprises: a torsion spring disposed over a cross pin, said cross pin being engaged with the torsion spring in a manner that turning the cross pin clockwise applies a compression force onto the torsion spring that places said torsion spring under tension, said cross pin being engaged with the inner ring in a manner that turning the cross pin clockwise turns the inner ring an equivalent degree turn in the same direction; and a clutch disk adapted for rotation, the clutch disk being engaged with the cross pin in such a manner that turning the cross pin clockwise also turns the clutch disk clockwise, said clutch disk being adapted for movement in a direction perpendicular to the rotation movement, said clutch disk containing a plurality of tabs attached to a top surface of the clutch disk.

2. The waste collection and isolating device of claim 1, wherein, with the inner ring in the second position and with a bag installed into the inner ring through the open space between the cords and a bag opening stretched over the outer surface of the external housing, turning the inner ring from the second position to the first position results in twisting of the cords around the bag opening and substantially closing said bag opening.

3. The waste collection and isolating device of claim 2, wherein, with the bag installed in the inner ring through the open space between the cords and a bag opening stretched over the outer surface of the external housing, placing the bag opening over a solid waste on a surface and turning the inner ring from the second position to the first position results in closing the opening of the bag under the solid waste and snaring the waste into the bag before closing the bag opening.

4. The waste collection and isolating device of claim 3, wherein the system for removing the solid waste comprises a drawstring threaded through a channel around the opening of the bag, said drawstring having a first end and a second end and, said system for removing the solid waste comprising a tab having a center aperture through which the first end of the drawstring and the second end of the drawstring are threaded, wherein said first end of the drawstring and the second end of the drawstring are combined behind said tab.

5. The waste collection and isolating device of claim 4, wherein the tab is wedged in a slot attached to the external housing and the drawstring portion behind the tab is placed in a groove attached to the external housing, wherein removing the solid waste remotely after snaring the solid waste inside the bag and closing the opening of the bag is accomplished by pulling the drawstring behind the bag, said pulling the drawstring resulting in drawing a bag closure toward the tab, said tab covering a drawn in closure of the bag.

6. The waste collection and isolating device of claim 1, further comprising a support spring being situated under the clutch disk, said support spring being adapted for applying a compressive force onto the clutch disk; and an outer housing containing the torsion spring, the clutch disk and the support spring, said outer housing having an upper wall, said upper wall containing a plurality of indentations, said plurality of tabs attached to the top surface of the clutch disk adapted to fit into corresponding indentations in the upper wall.

7. The waste collection and isolating device of claim 6, wherein three tabs are disposed on the clutch disk and the upper wall of the outer housing contains three indentations.

8. The waste collection and isolating device of claim 1, wherein the cross pin is wedged in a groove on an inside of a turning collar, said turning collar being disposed over the external housing and wherein the turning collar is adapted for turning clockwise from a first position to a second position in a manner as to turn the cross pin clockwise and to turn the inner ring from the first position of the inner ring to the second position of the inner ring.

9. The waste collection and isolating device of claim 8, wherein moving the turning collar clockwise from the first position to the second position resulting in turning the cross pin clockwise, applies a compression force onto the torsion spring and in placing the torsion spring under tension, said moving the turning collar clockwise from the first position to the second position also resulting in turning the clutch disk clockwise and in the insertion of each of the plurality of tabs disposed on the clutch disk into a corresponding indentation in the upper wall of the outer housing, said insertion of each of the plurality of tabs into a corresponding indentation in the upper wall results in locking the torsion spring under tension and securing the inner ring in the second position.

10. The waste collection and isolating device of claim 9, further comprising a handle, said handle being disposed over the upper wall of the external housing, wherein a bottom portion of said handle contains a plurality of prongs, wherein each of the plurality of prongs is positioned over a corresponding indentation in the upper wall.

11. The waste collection and isolating device of claim 10, wherein pressing the handle down while the clutch disk tabs are inserted in the indentations in the upper wall results in dislodging the tabs, and wherein dislodging the tabs on the clutch disk from the indentations in the upper wall results in releasing the compression on the torsion spring, moving the cross pin from the second position to the first position of the cross pin and moving the inner ring from the second position to the first position of the inner ring, said dislodging the tabs being caused by the plurality of prongs displacing the corresponding tabs from the corresponding indentations.

12. The waste collection and isolating device of claim 9, wherein said handle comprises an elongated middle section.

13. The waste collection and isolating device of claim 9, wherein said handle comprises a clip for housing a flash light.

14. The waste collection and isolating device of claim 9, wherein said handle comprises a bag storage compartment.

15. The waste collection and isolating device of claim 9 further comprising a lever arm, wherein a bottom portion of said lever arm contains a plurality of prongs, wherein each of the plurality of prongs is positioned over a corresponding indentation in the upper wall and wherein a top portion of the lever arm is engaged with a trigger disposed at a top portion of the handle in such a manner that an upward pull on the trigger produced a downward pressure onto the lever arm and onto the plurality of prongs, the downward pressure onto the plurality of prongs while the clutch disk tabs are inserted in the indentations in the upper wall causing dislodging of the tabs, and wherein dislodging the tabs on the clutch disk from the indentations in the upper wall results in releasing the compression on the torsion spring, moving the cross pin from the second position to the first position of the cross pin and moving the inner ring from the second position to the first position of the inner ring, said dislodging the tabs being caused by the plurality of prongs displacing the corresponding tabs from the corresponding indentations.

16. The waste collection and isolating device of claim 9 further comprising a rod, wherein a bottom portion of the rod contains a plurality of prongs, wherein each of the plurality of prongs is disposed over a corresponding indentation in the upper wall and wherein a top portion of the rod is engaged with a push button positioned at a top portion of the handle in a manner that a downward pressure onto the button transmits said pressure onto the plurality of prongs, wherein the downward pressure onto the plurality of prongs while the clutch disk tabs are inserted in the indentations in the upper wall causes dislodging the tabs, and wherein dislodging the tabs on the clutch disk from the indentations results in releasing the compression on the torsion spring, moving the cross pin from the second position to the first position of the cross pin and moving the inner ring from the second position to the first position of the inner ring, said dislodging the tabs being caused by the plurality of prongs displacing the corresponding tabs from the corresponding indentations.

17. The waste collection and isolating device of claim 1, wherein an upper wall inside the external housing contains a gripping member configured for gripping a portion of the bag.

18. A method for picking up and isolating waste comprising:

providing a waste collection and isolating device, the waste collection and isolating device containing: a system for ensnaring solid waste in a bag; a system for removing the solid waste; and a mechanism for activating the system for ensnaring the solid waste in the bag;

rotating a turning collar of the waste collection and isolating device to a second position from a first position, the first position corresponding to a state of minimum open space between cords attached to a bottom of a waste collection housing, said second position corresponding to a state of maximum open space between the cords attached to a bottom of a waste collection housing;

installing a containment system into the waste collection housing such that a containment system bag is stretched over the bottom of the waste collection housing to form an opening to an inside of the bag;

placing the opening of the bag over a solid waste disposed on a surface and pressing onto a handle, wherein pressing down on the handle triggers the mechanism for activating the system for picking up the solid waste in the bag, the picking up being accomplished by entangling the cords around the bag opening and under the solid waste, causing the solid waste to be ensnared inside the bag and causing the turning collar to return to said first position;

isolating the solid waste by closing the opening of the bag, said closing the opening of the bag being accomplished by pulling on a drawstring, said pulling on the drawstring causing a drawing-in of the bag opening; and disposing of the bag with the ensnared solid waste.

19. The method for picking up and isolating waste of claim 18 further comprising moving a drawn-in bag opening toward a tab placed in a fixed position such that the drawn-in opening of the bag is covered by the tab.

20. The method for picking up and isolating waste of claim 18, wherein setting the turning collar of the waste collection and isolating device to the second position renders a torsion spring into a compressed state and a clutch disk to lock it in this state.

21. The method for picking up and isolating waste of claim 18, wherein pressing down on the handle releases a tension on the compressed torsion spring causing said torsion spring to rotate an inner ring counterclockwise, the rotation of the inner ring counterclockwise causing the cords to entangle and causing the turning collar of the waste collection and isolating device to return to the first position from the second position, said first position corresponding to a state of minimum open space between the cords attached to the bottom of the waste collection housing.

* * * * *